US005932515A

United States Patent [19]

Rourke

[11] Patent Number: 5,932,515

[45] Date of Patent: Aug. 3, 1999

[54] RECORDING PAPER INCORPORATING HOLLOW SPHERICAL PLASTIC PIGMENT

[75] Inventor: John Kevin Rourke, Chillicothe, Ohio

[73] Assignee: The Mead Corporation, Dayton, Ohio

[21] Appl. No.: 08/977,916

[22] Filed: Nov. 25, 1997

[51] Int. Cl.[6] ..... B41M 5/155

[52] U.S. Cl. ..... 503/215; 106/31.16; 106/31.17; 106/31.18; 503/207; 503/214; 503/216; 503/225

[58] Field of Search ..... 106/31.16, 31.17, 106/31.18; 503/200, 215, 216, 214, 225, 226; 427/150–152

[56] References Cited

U.S. PATENT DOCUMENTS

| | | | |
|---|---|---|---|
| 4,440,846 | 4/1984 | Sanders et al. | 430/138 |
| 4,468,498 | 8/1984 | Kowlaski et al. | 525/301 |
| 4,469,825 | 9/1984 | Kowlaski et al. | 523/201 |
| 4,477,518 | 10/1984 | Cremona et al. | 428/327 |
| 4,594,363 | 6/1986 | Blakenship et al. | 521/64 |
| 4,677,003 | 6/1987 | Redlich et al. | 427/373 |
| 4,829,102 | 5/1989 | Biale | 523/201 |
| 4,859,561 | 8/1989 | Metz et al. | 430/138 |
| 4,885,320 | 12/1989 | Biale | 523/201 |
| 4,916,617 | 4/1990 | Brown et al. | 523/161 |
| 4,920,160 | 4/1990 | Chip et al. | 523/201 |
| 4,956,309 | 9/1990 | Adair et al. | 430/138 |
| 5,026,782 | 6/1991 | Biale | 525/317 |
| 5,030,666 | 7/1991 | Kowalski et al. | 523/201 |
| 5,034,302 | 7/1991 | Adair et al. | 430/138 |
| 5,053,441 | 10/1991 | Biale | 523/201 |
| 5,075,153 | 12/1991 | Malhotra | 428/207 |
| 5,135,568 | 8/1992 | Fasano | 106/20 |
| 5,212,251 | 5/1993 | Lorah et al. | 525/279 |
| 5,304,707 | 4/1994 | Blankenship et al. | 588/255 |
| 5,342,649 | 8/1994 | Sarokin | 427/150 |
| 5,403,894 | 4/1995 | Tsai et al. | 525/285 |
| 5,494,971 | 2/1996 | Anderson et al. | 525/301 |
| 5,508,072 | 4/1996 | Blankership | 525/301 |
| 5,510,422 | 4/1996 | Blankenship et al. | 525/301 |
| 5,527,613 | 6/1996 | Blankenship | 428/301 |
| 5,624,743 | 4/1997 | Malhorts | 428/216 |
| 5,677,043 | 10/1997 | Hultman et al. | 428/212 |

*Primary Examiner*—Bruce H. Hess
*Attorney, Agent, or Firm*—Thompson Hine & Flory LLP

[57] ABSTRACT

A developer sheet for use in pressure-sensitive carbonless paper which incorporates a hollow microspherical plastic pigment.

26 Claims, No Drawings

RECORDING PAPER INCORPORATING HOLLOW SPHERICAL PLASTIC PIGMENT

The present invention relates to developer sheets for use in copy systems such as pressure-sensitive carbonless paper, and, more particularly, to developer sheets incorporating a hollow microspherical plastic pigment.

BACKGROUND OF THE INVENTION

Carbonless copy systems and other copying systems employing a color precursor and a developer are well known in the art. These systems can comprise two sheets, a transfer or donor sheet which contains a colorless color-forming agent on one of its surfaces which is often contained in pressure rupturable microcapsules and a developer or receiver sheet, which is typically a substrate having a layer of a developer material coated onto its front surface which can react with the colorless color-forming agent to form a visible image. In practice, to produce an image, the two sheets are juxtaposed so that the colorless color-forming agent faces the developer material. Upon the application of pressure, such as a pen, pencil, typewriter, or other writing instrument, the microcapsules are ruptured which releases the colorless color-forming agent. The color-forming agent reacts with the developer material on the developer sheet to form a visible image.

Transfer pressure-sensitive systems as described above are only one type of imaging system employing a color precursor and a developer. Other types that are known in the art are self-contained systems in which the color precursor and the developer are carried together on the same support (e.g., in the same or separate layers). Another type of copy system which employs a color precursor and a developer is thermal recording systems in which the color precursor is activated through the application of heat. Light sensitive copy systems such as the CYCOLOR system described in U.S. Pat. No. 4,399,209 are still another type of system which relies upon the interaction of a color precursor and a developer to form images.

SUMMARY OF THE INVENTION

The present invention provides a recording sheet and recording systems including the same which provides improved image intensity. The recording sheet is characterized in that it utilizes gas-filled microspheres which are distributed throughout a layer of a developer material. The compressible quality of these microspheres is believed to provide improved conformity of surfaces between the developer sheet and the transfer sheet and thereby improve transfer. Furthermore, upon the application of an image-forming pressure, the microspheres contained in the developer sheet are believed to rupture, collapse, or dissolve and thereby form an interconnected network of microscopic voids. The microscopic voids are believed to provide improved image intensity as a result of increased surface area of the developer materials and capillary action. When a visible image is produced by the reaction of a colorless chromogenic material with the particulate developer layer, it is desirable to have a large number of large pores in the developer layer. According to one capillary model for oil transfer, the density of the image produced is proportional to the square root of the effective capillary radius of the developer material. Accordingly, an increase of the number of pores and/or effective capillary radius pore size increases the force with which the color precursor is drawn into the developer layer and increases image density. The plastic pigment microspheres further enhance the image by contributing additional whiteness and opacity to the developer sheet.

One embodiment of the present invention is a developer sheet which provides faster development and improved image intensity through one or a combination of mechanisms. The developer sheet comprises a support having a developer layer on one side thereof, wherein the developer layer includes a developer material and hollow compressible gas-filled microspheres interspersed within said developer layer.

The present invention further provides for a self-contained paper utilizing microspheres distributed throughout the matrix. In self-contained paper microcapsules containing a color precursor are added to the developer sheet. The microspheres offer generally the same improvements in self contained paper as they do in developer sheets, including higher-fidelity image reproduction and additional whiteness and opacity of the sheet. The term "recording sheet" is used herein as a generic reference to developer sheets and self-contained papers and the term "recording layer" is used as a generic reference to a developer layer and a self-contained recording layer.

Other objects and advantages of the present invention will be more fully understood and appreciated by reference to the following description and the appended claims.

DETAILED DESCRIPTION

In describing the preferred embodiment, certain terminology will be utilized for the sake of clarity. It is intended that such terminology include not only the recited embodiments but all technical equivalents which operate in a similar manner, for a similar purpose, to achieve a similar result.

The recording sheet of the present invention may be used in any imaging system in which a color precursor is reacted with a developer to form an image. More particularly, it may be used in pressure-sensitive transfer recording systems, pressure-sensitive self-contained recording systems, and thermal or heat-sensitive recording systems.

In accordance with another embodiment, the recording sheet of the present invention may be used in a photosensitive recording system. Photosensitive compositions, photoinitiators, color formers, wall formers, encapsulation techniques and developer materials useful in photosensitive recording systems are described in U.S. Pat. Nos. 4,399,209; 4,772,530; and 4,772,541 are useful herein. These patents are incorporated herein by reference.

The recording sheet includes a substrate having a front surface and a back surface. The substrate is typically paper but in certain applications it may be made of transparent polymeric materials such as polyethylene terephthalate, translucent substrates, opaque polymeric substrates such as Melinex 329 and Melinex 470 sold by ICI Americas, or polymer coated paper materials such as commercially available photographic papers and plain paper.

The microspheres used in the present invention are hollow spherical pigment particles made from a synthetic organic polymer or any inorganic shell-forming material such as glass or sodium silicate. Typically such microspheres have a diameter of approximately $0.3\mu$ to $15\mu$ and preferably about 1.0 micron. Such hollow synthetic organic pigment particles are known in the art and are commercially available from Rohm and Haas Corp. The microspheres provide a network of gas-filled voids in the developer layer. One example of a commercially available microspheres that is useful in the present invention is sold under the trade designation HP-1055 from Rohm and Haas. Hollow polymer particles which are useful in this invention may be made in accordance with and having the properties disclosed in U.S. Pat. Nos. 3,784,391; 4,798,691; 4,908,271; 4,910,229; and 4,972,000; and Japanese Patent Applications 60/223873; 61/62510; 61/66710; 61/86941; 62/127336; 62/156387; 01/185311; and 02/140272; U.S. Pat Nos. 4,427,836; 4,469,825; 4,594,363; and 4,880,842. The disclosures therein related to the manufacture and composition of the hollow polymer particles are incorporated herein by reference. The preferred pigment has a soft compressible quality that yields a microscopic void under the application of writing or marking pressure.

Any of the developer materials that has been conventionally used or taught for use in any of the aforesaid recording systems should be useful in the recording sheets of this invention. The developer material is selected such that it reacts with the color precursor to produce a high density image. In the most typical embodiments, the color precursor is a substantially colorless electron donating compound of the type conventionally used in the pressure-sensitive recording art and the developer material is a solid particulate electron accepting compound.

The developer can be selected from among the developers conventionally used in carbonless paper including acid clay, active clay, attapulgite, etc.; organic acids such as tannic acid, gallic acid, propylgallate; aromatic carboxylic acids such as benzoic acid, p-tert-butyl-benzoic acid, 4-methyl-3-nitro-benzoic acid, salicylic acid, 3-phenyl salicylic acid, 3-cyclohexyl salicylic acid, 3-tert-butyl-5-methyl salicylic acid, 3,5-ditert-butyl salicylic acid, 3-methyl-5-benzyl salicylic acid, 3-phenyl-5-(α,α-dimethylbenzyl)salicylic acid, 3-cyclohexyl-5-(α,α-dimethylbenzyl)salicylic acid, 3-(α,α-dimethylbenzyl)-5-methyl salicylic acid, 3,5-dicyclohexyl salicylic acid, 3,5-di-(α-methylbenzyl)salicylic acid, 3,5-di-(α,α-dimethylbenzyl)salicylic acid, 3-(α-methylbenzyl)-5-(α,α-dimethylbenzyl)salicylic acid, 4-methyl-5-cyclohexyl salicylic acid, 2-hydroxy-1-benzyl-3-naphthoic acid, 1-benzoyl-2-hydroxy-3-naphthoic acid, 3-hydroxy-5-cyclohexyl-2-naphthoic acid and the like, and polyvalent metallic salts thereof such as zinc salts, aluminum salts, magnesium salts, calcium salts and cobalt salts as disclosed in U.S. Pat. Nos. 3,864,146; 3,924,027 and 3,983,292; phenol compounds such as 6,6'-methylene-bis(4-chloro-m-cresol) as disclosed in Japanese Patent Publications 9,309 of 1965 and 20,144 of 1967, and Japanese Laid Open Patent Publication No. 14,409 of 1973; acid polymers such as maleic acid-rosin resin and copolymers of maleic anhydride with styrene, ethylene or vinylmethylether; and aromatic carboxylic acid-aldehyde polymers, aromatic carboxylic acid-acetylene polymers and their polyvalent metallic salts as disclosed in U.S. Pat. Nos. 3,767,449 and 3,772,052.

Preferred developer materials are phenolic resins, such as phenol-aldehyde resins e.g., p-phenyl-phenolformaldehyde resin; phenol-acetylene resins, e.g., p-tert-butylphenol-acetylene resin; polyvalent metallic salts thereof such as zinc modified phenol formaldehyde resin as disclosed in U.S. Pat. No. 3,732,120, and phenolic resins modified to include amounts of unsubstituted or substituted salicylic acids in a manner known in the art. One class of phenolic resin useful in the present invention is the product of oxidative coupling of substituted or unsubstituted phenols or bisphenols. Oxidative coupling may be catalyzed by various catalysts but a particularly desirable catalyst is the enzyme peroxidase. Particularly desirable developers are the resins described in commonly assigned U.S. Pat. No. 4,647,952, which is incorporated herein by reference, and more particularly the product of oxidative coupling of bisphenol A.

Especially preferred developer materials are phenolformaldehyde condensation products. More particularly, alkylphenolic resins and, still more particularly, metallated products of alkylphenolic resins are preferred. The alkyl phenols are monosubstituted by an alkyl group which may contain 1 to 12 carbon atoms. Examples of alkyl phenols are ortho- or para-substituted ethylphenol, propylphenol, butylphenol, amylphenol, hexylphenol, heptylphenol, octylphenol, nonylphenol, t-butylphenol, t-octylphenol, etc. Another class of thermoplastic developer material which may be used within the scope of the present invention is a resin-like condensation product of a polyvalent metal salt, such as a zinc salt, and a phenol, a phenol-formaldehyde condensation product, or a phenol-salicylic acid-formaldehyde condensation product.

Useful phenolic developer resins are available from Schenectady Chemical Co. under the designations HRJ 2969, HRJ 4250 and HRJ 4542. The latter two products are reported to be a metallated condensation product of an ortho- or para-substituted alkylphenol, a substituted salicylic acid, and formaldehyde.

A binder is used to improve the scuff resistance of the recording layer. The amount of binder used in the composition will vary depending upon the nature of the binder material.

Because the binder suppresses the reactivity of the developer, the amount of binder should be minimized. Generally, the amount of binder is determined by balancing image intensity and scuff resistance and will fall within the range of about 2 to 20% and more typically about 5 to 16%.

A binder used in the present invention is mixed with the developer resin and/or microspheres to form a developer coating. The binder acts to enhance the surface strength of the coating as well as to adhere the coating to the substrate. The binder employed may be a natural binder, a synthetic binder or a combination thereof. In one embodiment, a synthetic binder such as polyvinyl alcohol is used alone or in combination with other synthetic binders or with a natural binder such as ethylated cornstarch. Synthetic binders are preferred because they are stronger than natural binders and the surface strength of the developer sheet can be maintained without affecting image development. Illustrative examples of synthetic binders include polyvinyl acetate and copolymers thereof, styrene butadiene rubber (SBR), polyvinyl alcohol, polystyrene, butadiene-styrene copolymers, polyvinylpyrrolidone, acrylic homo- or copolymers such as acrylic or methacrylic acids or lower alkyl esters thereof, e.g., ethyl acrylate, butyl acrylate and methyl methacrylate, acrylamide and the like. Illustrative examples of natural binders are gum arabic, casein, sodium alginate, methyl cellulose, carboxymethyl cellulose, dextrin, starch or modified starches, e.g., oxidized, hydrolyzed or hydroxyethylated starch, and the like.

The recording layer may also include in the coating solution a viscosity increasing additive, typically a water-soluble material, which significantly increases the viscosity of the coating layer upon removal of the coating solvent. Further optionally incorporated with the thermoplastic developer material is one or more dispersing agents (e.g., Dispex N-40, polymeric carboxylic acid from Allied Colloids, Inc.). Other commonly utilized additives such as anti-foaming agents, structured clays (e.g., Exsilon 87 and Ansilex 93 from Englehard Corp., as described in U.S. Pat. No. 5,350,729 to Londo et al.), optical whitening agents (e.g., Tinopal PT-150 from Ciba Geigy Corp.) and lubricants (e.g., Nopcote C-105HS calcium stearate dispersion from Henkel Corp.) may also be added in minor amounts.

To produce the recording sheet, the developer material is dispersed in a liquid, typically water, to form a resin dispersion, and binder material, microspheres, and optional additives are mixed into the dispersion. Once the dispersion is well mixed, it is coated onto the support by coating means known in the art. For example, a Meyer bar coater may be used. In practice, the developer layer is applied in an amount of about 1.0 to 2.0 pounds per 1700 sq. ft.

The developer resin is used in an amount sufficient to react with a color precursor and form as image. In a preferred embodiment, the developer layer contains about 4 to 40% developer and about 5 to 50 wt. % microspheres. Preferably, the amount of developer resin used is about 10% to 15% based on dry weight. Upon application of an image inducing pressure, the hollow spherical plastic pigment particles are believed to collapse, compress, rupture, or dissolve to form an interconnecting network of microscopic voids. The exact mechanism whereby the pigment improves the performance of the developer sheet is not clear. The pigment is believed to provide a network of voids which greatly increases the availability of and access to the reactive developer particles by the color precursor. The compressed or ruptured microspheres are believed to provide an increased surface area in the developer sheet which can react with the chromogenic materials. Furthermore, by capillary action, the network of voids also imbibe and distribute the chromogenic material and induce its delivery to the newly-exposed reaction sites. The presence of the microspheres additionally impart increased compressibility and conforming characteristics to the developer sheet. Thus, the developer sheet better conforms to the transfer sheet when pressure is applied. The improved conformity of surfaces between the two sheets is believed to provide a higher fidelity of image reproduction and more rupturing of the dye-bearing capsules that fall within the image area.

Self-contained papers are a further embodiment of the present invention. Under this embodiment, a microencapsulated color precursor, particulate reactive developer material, stilts (optional), binder and microspheres are combined in a single coating and coated onto a substrate to thereby form a carbonless self-contained paper. The self contained paper contains the microencapsulated color precursor, microspheres and developer materials in the same matrix. Accordingly, upon application of an image inducing pressure, the microcapsules containing the color precursor are ruptured, and the color former leeches into the matrix. The color former then reacts with the reactive materials in its immediate surroundings, thereby producing a visible image.

The advantages provided by the presence of microspheres in self-contained paper is analogous to the advantages provided in developer sheets.

Substantially any of the color precursors conventionally used in carbonless paper can be used in the present invention. In general, these materials are colorless electron donating type compounds. Representative examples of such color formers include substantially colorless compounds having in their partial skeleton a lactone, a lactam, a sultone, a spiropyran, an ester or an amido structure. Specifically, there are triarylmethane compounds, bisphenylmethane compounds, xanthene compounds, thiazine compounds, spiropyran compounds and the like. Typical examples of them include Crystal Violet lactone, benzoyl leuco methylene blue, Malachite Green Lactone. p-nitrobenzoyl leuco methylene blue, 3-dialkylamino-7-dialkylamino-fluoran, 3-methyl-2,2'-spirobi(benzo-f-chrome), 3,3-bis(p-dimethylaminophenyl)phthalide, 3-(p-dimethylaminophenyl)-3-1,2-dimethylindole-3-yl) phthalide, 3-(p-dimethylaminophenyl)-3-(2-phenylindole-3-yl)phthalide, 3(p-dimethylaminophenyl)-3-(2-phenylindole-3-yl)phthalide, 3,3-bis(1,2-dimethylindole-3-yl)-5-dimethylaminophthalide, 3,3-bis-(1,2-dimethylindole-3-yl) 6-dimethylaminophthalide, 3,3-bis-(9-ethylcarbazole-3-yl)-5-dimethylaminophthalide, 3,3-bis(2-phenylindole-3-yl)-5-dimethylaminophthalide, 3-p-dimethylaminophenyl-3-(1-methyl pyrrole-2-yl)-6-dimethylaminophthalide, 4,4'-bis-dimethylaminobenzhydrin benzyl ether, N-halophenyl leuco Auramine, N-2,4,5-trichlorophenyl leuco Auramine, Rhodamine-B-anilinolactam, Rhodamine-(p-nitroanilino) lactam, Rhodamine-B-(p-chloroanilino)lactam, 3-dimethylamino-6-methoxyfluoran, 3-diethylamino-7-methoxyfluoran, 3-diethylamino-7-chloro-6-methyl-fluroan, 3-diethylamino-6-methyl-7-anilinofluoran, 3-diethylamino-7-(acetylmethylamino)fluoran, 3-diethylamino-7-(dibenzylamino)fluoran, 3-diethylamino-7-(methylbenzylamino)fluoran, 3-diethylamino-7-(chloroethylmethylamino)fluoran, 3-diethylamino-7-(diethylamino)fluoran, 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methylnaphtho-(3-methoxybenzo)-spirpyran, 3-propyl-spirodibenzoidipyran, etc. Mixtures of these color precursors can be used if desired. The present invention, however, is not limited to the use of the aforementioned color precursors as chromogenic materials. In addition, organic chemicals which are capable of reacting with heavy metal salts to give colored metal complexes, chelates or salts can be adapted for use in this invention.

Substantially any color forming material which can be encapsulated and which will react with a developer material to form an image can be used in the present invention.

In addition to the chromogenic material, the internal phase of the microcapsules also includes a solvent oil. Preferred solvent oils are weakly polar solvents having boiling points above 170° C. and preferably in the range of 180° C. to 300° C. The solvent oil may optionally include a hydrocarbon diluent. The solvent oils used in the present invention are typically those conventionally used in carbonless paper manufacture. These oils are generally characterized by their ability to dissolve Crystal Violet Lactone in a concentration of 0.5 wt % or more. Whether a diluent oil should be used will depend on the solubility of the chromogenic material, the nature of the chromogenic material and the viscosity of the characteristics of the internal phase. Examples of solvent oils include alkylated biphenyls (e.g., monoisopropylbiphenyl), polychlorinated biphenyls, castor oil, naphthenic mineral oils, dibutyl phthalate, brominated paraffin, dibutyl fumerate, and mixtures thereof. Alkylated biphenyls are generally less toxic and preferred. Examples of diluent oils include mineral oil and deodorized kerosene.

The color precursor is incorporated in the internal phase in an amount sufficient to produce a visible image of the desired optical density upon reaction with the developer. In general, these amounts range from approximately 0.5 to about 20.0 percent based on the weight of the internal phase solution (e.g., monomer or oil) containing the chromogen. A preferred range is from about 2 percent to about 10 percent. The amount of the chromogenic material required to obtain suitable images depends on the nature of the chromogen, the nature of the internal phase, the nature of the capsule wall structure, and the size of the microcapsules.

The mean size of the capsules used in the present invention generally ranges from approximately 1 to 25 microns. As a general rule, image resolution improves as the capsule size decreases with the caveat that if the capsule size is too small, depending on the nature of the substrate on which the capsules are coated, the capsules may disappear in the pores or the fiber in the substrate, but capsules even as large as 25 microns provide satisfactory resolution in the present invention. In the latter case, the incongruities in the substrate may screen the capsules from exposure and thereby diminish image quality. They may also fail to rupture upon the application of pressure.

The microcapsules used in the present invention can be prepared by well known methods. For example, an oil solution of the internal phase comprising the chromogenic composition is dispersed in a continuous phase containing the wall-forming constituents, and microencapsulation is accomplished by, for example, coacervation or interfacial polymerization, among others.

To prepare self-contained sheets, the developer material may be mixed with the microcapsule composition and the mixture applied to the substrate web, or the developer material may be pre-coated onto the substrate as a separate contiguous layer, or it may be overcoated onto a microcapsule-bearing pre-coated layer. A self-contained coating composition will typically contain about 20 to 60% microcapsules, about 10 to 50% hollow microspheres, and about 5 to 40% developer material. The amount of binder will vary depending on the nature of the binder as described above. The self-contained coating will be applied at a coat weight of about 1 to 2 pounds per 1300 sq. ft. The practices used in U.S. Pat. No. 4,010,292 to prepare self-contained sheets are also useful in the present invention. Any ordinary coating or printing technique can be used in making imaging sheets in accordance with the invention including such means as roller or blade coating.

The self-contained coating compositions of this invention may contain any of the various additives known in the carbonless paper art to improve the handling characteristics of the coated copy sheet such as a stilt material (e.g., starch particles), silica particles to prevent specking when a pressure nip is used for capsule rupture, etc.

One example of a useful developer coating is shown in Table 1 below.

TABLE 1

| | Dry Weight % |
|---|---|
| Developer: HRJ 2969 Phenolic Resin (Schenectady Chemical Co.) | 17 |
| Binder: (2:1 mixture) Penford Gum 200 ethylated cornstarch (Penford Products Co.) Airvol 165 Polyvinyl alcohol (Air Products and Chemicals, Inc.) | 5 |
| Hollow Plastic Pigment: HP-1055 Plastic Pigment (Rohm and Haas Co.) | 23 |
| Other Additives: Dispex N-40 (Allied Colloids) (1 part) Exsilon 87 (Englehard Corp.) (50 parts) Ansilex 93 (Englehard Corp.) (16 parts) Tinopal PT-150 (Ciba Geigy Corp.) (0.4 parts) Nopcote C-104HS (Henkel Corp.) 1.5 parts) | 55 |

Another example of a useful developer composition is formulated as set forth in Table 1 except it contains 10% binder and 50% of the "Other Additive" mix shown in Table 1. Unless otherwise indicated, all percentages are dry weight.

An example of a useful self-contained coating composition is shown in Table 2 below.

TABLE 2

| | Dry Weight % |
|---|---|
| Capsules: Standard Blue-Forming Capsules (6% dye content) | 36.5 |
| Developer: HRJ 2969 Phenolic Resin (Schenectady Chemical Co.) | 12.5 |
| Hollow Plastic Pigment: HP-1055 (Rohm and Haas Corp.) | 16.0 |
| Stilts: Keestar 328 Starch (Ogilvie Mills, Inc.) | 28.7 |
| Binder: Penford Gum 200/ Airvol 165 (2:1 mixture) | 6.0 |
| Optical Brightener: Tinopal PT | 0.3 |

The present invention is illustrated in more detail by the following non-limiting examples.

EXAMPLE 1

Developer coating compositions were prepared using the binder, developer resin, plastic pigment and other additives (combined mix) identified in Table 1. These materials were blended in the amounts shown in Table 3 below. The compositions were formulated as aqueous dispersions containing 18% solids. The compositions were drawn down on a 12.5 pound rawstock using a #10 Meyer rod, dried, and conditioned in a constant humidity room. The coat weight of each sample is shown in Table 4.

Each developer coating formulation was tested by evaluating the image response to both a standard microcapsule bearing blue-imaging (Control) CB sheet and to a standard black-imaging (Control) CB sheet. A conventional standard (Control) CF coated sheet was also imaged against those same standard CB sheets, at the same time, and under the same conditions, in order to generate a comparative reference data set. The reflectance measurements used to characterize the test specimens were made using a Technidyne BNL-2 Opacimeter.

Three types of imaging tests were used to evaluate the coated specimens. These are referred to in the accompanying tables as Smudge, Calender Intensity (C.I.), and Typewriter Intensity (T.I.). For all three tests the intensities of the resulting images were reported (in percent) as the ratio of light reflected from the imaged area versus the unimaged (background) area. Thus, the more intense or darker images appear as lower values, and the higher values indicate weak or faint images. All blue-imaged test results are reported in Table 4. The black-imaged results are reported in Table 5. The nature of each testing procedure may be described as follows.

Smudge: The CF sheet is dragged across the mated CB sheet for a prescribed distance, while under a prescribed pressure loading. The resulting discoloration (image)is measured after ten minutes development time. The higher the Smudge value the better the result.

Calender Intensity: The sheet couples are passed one time through the nip formed by a pair of steel calender rolls. The reflectance of each imaged area was measured after two minutes, and again after five minutes development time. The Calender Intensity test results are also sometimes referred to as Print Speed. The lower the C.I value the better the result.

Typewriter Intensity: The sheet couples were imaged with an electric typewriter using the character "m" in a repeating, half spaced block pattern. The images were evaluated after ten minutes development time. The lower the T.I. value the better the result.

The reported test values may be expressed mathematically as follows:

Smudge=$(R_i/R_o)$ (100),

C.I.=$(R_i/R_o)$ (100), and,

T.I.=$(R_i/R_o)$ (100), where $R_i$ is the average reflectance of the imaged area of the respective test, and, $R_o$ is the average reflectance of the unimaged area of the specimen.

The remaining values listed in the tables are indices used to indicate and quickly assess the magnitude of effects. These are:

ΔC.I.=(5 min. C.I.)−(2 min. C.I.); the difference between the Calender Intensity after 5 minutes versus after 2 minutes development time. The smaller the value the faster the image development.

ΔT.I.=(Smudge)−(T.I.); the difference between Smudge and Typewriter Intensity. The larger the value the more favorable the outcome.

Δ2'C.I.=(Smudge)−(2 min. C.I.); the difference between Smudge and two min. Calender Intensity. The larger the value the more favorable the outcome.

Δ5'C.I.=(Smudge)−5 min. C.I.); the difference between Smudge and five min. Calender Intensity. The larger the value the more favorable the outcome.

The testing results show that developer compositions containing the plastic pigment generally provide higher intensity over background (Δ) than the control.

TABLE 3

| | % of Dry weight | | | |
|---|---|---|---|---|
| Sample No. | Binder | Plast. Pig. | Resin | Other |
| 1 | 15 | 10 | 17 | 58 |
| 2 | 5 | 10 | 7 | 78 |
| 3 | 15 | 30 | 7 | 48 |
| 4 | 10 | 20 | 7 | 63 |
| 5 | 15 | 20 | 12 | 53 |
| 6 | 15 | 10 | 17 | 58 |
| 7 | 5 | 10 | 7 | 78 |
| 8 | 5 | 30 | 17 | 48 |
| 9 | 15 | 30 | 17 | 38 |
| 10 | 10 | 30 | 17 | 43 |
| 11 | 5 | 10 | 17 | 68 |
| 12 | 10 | 10 | 12 | 68 |
| 13 | 5 | 30 | 7 | 58 |
| 14 | 5 | 30 | 12 | 53 |
| 15 | 15 | 30 | 17 | 38 |
| 16 | 15 | 10 | 7 | 68 |
| 17 | 15 | 10 | 7 | 68 |
| 18 | 15 | 30 | 17 | 38 |
| 19 | 5 | 20 | 17 | 58 |
| 20 | 5 | 30 | 7 | 58 |

TABLE 4

| | | | Imaged Against T/R Control CB Blue | | | | | | | |
|---|---|---|---|---|---|---|---|---|---|---|
| Sample No. | Coat Wt. | Init. Bkgd. | 10 min. Smudge | 10 min. T.I. | 2 min. C.I. | 5 min. C.I. | Δ C.I. | Δ T.I. | Δ 2'C.I. | Δ 5'C.I. |
| 1 | 1.26 | 88.7 | 88.2 | 44.9 | 43.9 | 42.4 | 1.5 | 43.3 | 44.3 | 45.8 |
| 2 | 1.01 | 89.1 | 92.4 | 44.5 | 45.2 | 43.5 | 1.7 | 47.9 | 47.2 | 48.9 |
| 3 | 1.00 | 89.2 | 94.7 | 46.5 | 50.4 | 47.1 | 3.3 | 48.2 | 44.3 | 47.6 |
| 4 | 1.18 | 89.1 | 94.4 | 43.8 | 47.1 | 44.9 | 2.2 | 50.6 | 47.3 | 49.5 |
| 5 | 1.14 | 88.7 | 91.1 | 40.9 | 45.3 | 41.8 | 3.5 | 50.2 | 45.8 | 49.3 |
| 6 | 1.11 | 88.6 | 90.0 | 43.1 | 43.2 | 42.5 | 0.7 | 46.9 | 46.8 | 47.5 |
| 7 | 1.06 | 88.9 | 95.1 | 42.9 | 44.5 | 43.3 | 1.2 | 52.2 | 50.6 | 51.8 |
| 8 | 1.16 | 89.3 | 90.3 | 36.4 | 36.6 | 35.8 | 0.8 | 53.9 | 53.7 | 54.5 |
| 9 | 1.03 | 88.7 | 89.7 | 39.6 | 42.7 | 39.6 | 3.1 | 50.1 | 47.0 | 50.1 |
| 10 | 1.05 | 89.0 | 90.4 | 39.6 | 40.8 | 38.5 | 2.3 | 50.8 | 49.6 | 51.9 |
| 11 | 1.12 | 88.8 | 90.7 | 39.5 | 38.3 | 37.5 | 0.8 | 51.2 | 52.4 | 53.2 |
| 12 | 1.07 | 88.8 | 91.7 | 42.9 | 43.7 | 42.5 | 1.2 | 48.8 | 48.0 | 49.2 |
| 13 | 1.04 | 89.3 | 94.6 | 44.3 | 43.3 | 41.5 | 1.8 | 50.3 | 51.3 | 53.1 |
| 14 | 1.05 | 89.3 | 93.0 | 39.6 | 38.7 | 38.2 | 0.5 | 53.4 | 54.3 | 54.8 |
| 15 | 0.95 | 88.7 | 89.2 | 42.0 | 45.0 | 41.5 | 3.5 | 47.2 | 44.2 | 47.7 |
| 16 | 1.06 | 88.7 | 92.5 | 51.0 | 57.0 | 53.5 | 3.5 | 41.5 | 35.5 | 39.0 |
| 17 | 1.22 | 88.7 | 94.4 | 49.4 | 59.6 | 54.3 | 5.3 | 45.0 | 34.8 | 40.1 |
| 18 | 1.34 | 88.5 | 89.3 | 42.8 | 43.7 | 41.7 | 2.0 | 46.5 | 45.6 | 47.6 |
| 19 | 1.43 | 88.8 | 89.9 | 38.4 | 36.6 | 35.8 | 0.8 | 51.5 | 53.3 | 54.1 |
| 20 | 1.13 | 89.1 | 93.7 | 43.8 | 42.8 | 42.1 | 0.7 | 49.9 | 50.9 | 51.6 |
| Std. Cont. CF = | | 87.9 | 93.3 | 48.7 | 51.8 | 49.5 | 2.3 | 44.6 | 41.5 | 43.8 |

TABLE 5

| | | | Imaged Against CB Black | | | | | | | |
|---|---|---|---|---|---|---|---|---|---|---|
| Sample No. | Coat Wt. | Init. Bkgd. | 10 min. Smudge | 10 min. T.I. | 2 min. C.I. | 5 min. C.I. | Δ C.I. | Δ T.I. | Δ 2'C.I. | Δ 5'C.I. |
| 1 | 1.26 | 88.7 | 84.2 | 44.6 | 43.5 | 42.1 | 1.4 | 39.6 | 40.7 | 42.1 |
| 2 | 1.01 | 89.1 | 90.6 | 51.1 | 48.2 | 47.7 | 0.5 | 39.5 | 42.4 | 42.9 |
| 3 | 1.00 | 89.2 | 91.9 | 52.7 | 59.0 | 53.8 | 5.2 | 39.2 | 32.9 | 38.1 |
| 4 | 1.18 | 89.1 | 90.7 | 52.2 | 52.7 | 49.7 | 3.0 | 38.5 | 38.0 | 41.0 |

TABLE 5-continued

| Imaged Against CB Black | | | | | | | | | | |
|---|---|---|---|---|---|---|---|---|---|---|
| Sample No. | Coat Wt. | Init. Bkgd. | 10 min. Smudge | 10 min. T.I. | 2 min. C.I. | 5 min. C.I. | Δ C.I. | Δ T.I. | Δ 2'C.I. | Δ 5'C.I. |
| 5 | 1.14 | 88.7 | 90.1 | 46.1 | 49.8 | 46.1 | 3.7 | 44.0 | 40.3 | 44.0 |
| 6 | 1.11 | 88.6 | 87.1 | 44.5 | 44.8 | 42.3 | 2.5 | 42.6 | 42.3 | 44.8 |
| 7 | 1.06 | 88.9 | 90.3 | 49.9 | 49.2 | 49.3 | −0.1 | 40.4 | 41.1 | 41.0 |
| 8 | 1.16 | 89.3 | 87.8 | 40.1 | 37.4 | 36.6 | 0.8 | 47.7 | 50.4 | 51.2 |
| 9 | 1.03 | 88.7 | 88.6 | 41.9 | 48.9 | 46.2 | 2.7 | 46.7 | 39.7 | 42.4 |
| 10 | 1.05 | 89.0 | 87.1 | 40.2 | 44.2 | 40.4 | 3.8 | 46.9 | 42.9 | 46.7 |
| 11 | 1.12 | 88.8 | 85.2 | 40.4 | 38.8 | 37.8 | 1.0 | 44.8 | 46.4 | 47.4 |
| 12 | 1.07 | 88.8 | 89.3 | 45.4 | 43.0 | 41.6 | 1.4 | 43.9 | 46.3 | 47.7 |
| 13 | 1.04 | 89.3 | 92.2 | 50.5 | 49.0 | 47.9 | 1.1 | 41.7 | 43.2 | 44.3 |
| 14 | 1.05 | 89.3 | 90.2 | 43.4 | 40.4 | 39.8 | 0.6 | 46.8 | 49.8 | 50.4 |
| 15 | 0.95 | 88.7 | 88.8 | 42.9 | 48.3 | 44.2 | 4.1 | 45.9 | 40.5 | 44.6 |
| 16 | 1.06 | 88.7 | 89.4 | 55.2 | 59.6 | 57.8 | 1.8 | 34.2 | 29.8 | 31.6 |
| 17 | 1.22 | 88.7 | 92.2 | 54.4 | 64.1 | 59.2 | 4.9 | 37.8 | 28.1 | 33.0 |
| 18 | 1.34 | 88.5 | 87.9 | 43.7 | 48.5 | 44.9 | 3.6 | 44.2 | 39.4 | 43.0 |
| 19 | 1.43 | 88.8 | 87.5 | 40.7 | 38.4 | 37.2 | 1.2 | 46.8 | 49.1 | 50.3 |
| 20 | 1.13 | 89.1 | 91.7 | 50.1 | 47.1 | 46.8 | 0.3 | 41.6 | 44.6 | 44.9 |
| Std. Control CF = | | 87.9 | 88.0 | 50.4 | 50.4 | 48.7 | 1.7 | 37.6 | 37.6 | 39.3 |

EXAMPLE 2

Self-contained coating compositions were prepared using capsules, developer, hollow plastic pigment, stilts, binder and optical brightener shown in Table 2 in the amounts shown in Table 6 below. The compositions were prepared as 18% solids suspensions in water and coated onto 12.5 pound rawstock using a #12 Meyer rod, dried and conditioned in a constant humidity room. The sheets were tested for applied coat weight in pounds per 1300 square feet, initial reflectance, smudge, typewriter intensity (T.I.) and calendar intensity (C.I.). The results are shown in Table 7.

TABLE 6

| Single-Pass Blue Imaging Self-Contained Dry Weight Fraction of Formulation; % | | | | | | |
|---|---|---|---|---|---|---|
| Sample No. | Dye Caps | Resin | Plast. Pig. | Stilts | Binder | Tinopal |
| 1 | 33.0 | 15.0 | 12.0 | 30.0 | 9.0 | 1.0 |
| 2 | 42.0 | 6.0 | 12.0 | 30.0 | 9.0 | 1.0 |
| 3 | 33.0 | 6.0 | 21.0 | 30.0 | 9.0 | 1.0 |
| 4 | 42.0 | 6.0 | 12.0 | 30.0 | 9.0 | 1.0 |
| 5 | 24.0 | 6.0 | 30.0 | 30.0 | 9.0 | 1.0 |
| 6 | 28.5 | 10.5 | 21.0 | 30.0 | 9.0 | 1.0 |
| 7 | 18.0 | 15.0 | 27.0 | 30.0 | 9.0 | 1.0 |
| 8 | 42.0 | 6.0 | 12.0 | 30.0 | 9.0 | 1.0 |
| 9 | 37.5 | 10.5 | 12.0 | 30.0 | 9.0 | 1.0 |
| 10 | 18.0 | 12.0 | 30.0 | 30.0 | 9.0 | 1.0 |
| 11 | 33.0 | 15.0 | 12.0 | 30.0 | 9.0 | 1.0 |
| 12 | 33.0 | 15.0 | 12.0 | 30.0 | 9.0 | 1.0 |
| 13 | 24.0 | 6.0 | 30.0 | 30.0 | 9.0 | 1.0 |

TABLE 7

| Test Results | | | | | | | | | | |
|---|---|---|---|---|---|---|---|---|---|---|
| Sample No. | Ct. Wt. lb/rm | Init. Bkgd. | 10 min. Smudge | 10 min. T.I. | 2 min. C.I. | 5 min. C.I. | Δ T.I. | Δ 2'C.I. | Δ 5'C.I. | Δ C.I. |
| 1 | 1.73 | 87.4 | 84.5 | 43.6 | 59.2 | 55.0 | 40.9 | 25.3 | 29.5 | 4.2 |
| 2 | 1.63 | 87.2 | 87.7 | 57.7 | 71.2 | 65.8 | 30.0 | 16.5 | 21.9 | 5.4 |
| 3 | 1.75 | 88.0 | 88.8 | 53.0 | 67.6 | 63.7 | 35.8 | 21.2 | 25.1 | 3.9 |
| 4 | 1.67 | 87.4 | 90.1 | 58.7 | 72.8 | 68.0 | 31.4 | 17.3 | 22.1 | 4.8 |
| 5 | 1.54 | 88.8 | 90.2 | 55.5 | 74.6 | 70.1 | 34.7 | 15.6 | 20.1 | 4.5 |
| 6 | 1.64 | 88.1 | 86.4 | 47.5 | 65.2 | 60.9 | 38.9 | 21.2 | 25.5 | 4.3 |
| 7 | 1.69 | 88.6 | 86.3 | 53.3 | 71.0 | 69.4 | 33.0 | 15.3 | 16.9 | 1.6 |
| 8 | 1.71 | 87.4 | 88.5 | 60.6 | 75.7 | 70.3 | 27.9 | 12.8 | 18.2 | 5.4 |
| 9 | 1.74 | 87.6 | 86.0 | 46.5 | 61.7 | 57.4 | 39.5 | 24.3 | 28.6 | 4.3 |
| 10 | 1.67 | 88.9 | 87.5 | 53.3 | 72.0 | 70.5 | 34.2 | 15.5 | 17.0 | 1.5 |
| 11 | 1.73 | 87.5 | 84.3 | 43.5 | 61.7 | 57.1 | 40.8 | 22.6 | 27.2 | 4.6 |
| 12 | 1.69 | 87.5 | 84.7 | 42.9 | 61.4 | 57.0 | 41.8 | 23.3 | 27.7 | 4.4 |
| 13 | 1.78 | 88.6 | 88.6 | 53.9 | 72.9 | 68.9 | 34.7 | 15.7 | 19.7 | 4.0 |

While the invention has been described herein by reference to specific embodiments thereof, it will be apparent that numerous modifications and variations are possible without departing from the spirit and scope of the following claims.

What is claimed is:

1. A recording sheet comprising:

a substrate having front and back surfaces; and a recording layer on said front surface, said recording layer including a developer material and gas-filled hollow compressible microspheres interspersed therein.

2. The recording sheet of claim 1 wherein said recording layer further includes a binder.

3. The recording sheet of claim 1 wherein said developer material is a phenolic resin.

4. The developer sheet of claim 1 wherein said developer material is an acid clay.

5. The developer sheet of claim 1 wherein said microspheres have a diameter of about 0.3 to 15 micron and are formed from an elastic synthetic organic polymer.

6. The developer sheet of claim 1 wherein said developer layer contains about 5 to 50 percent by weight microspheres and about 4 to 40 percent by weight developer material.

7. The developer sheet of claim 2 wherein said binder is a synthetic binder, a natural binder or a mixture thereof.

8. The developer sheet of claim 7 wherein said binder is selected from the group consisting of polyvinyl alcohol, polyvinyl acetate, polystyrene, butadiene-styrene copolymer, dextrin, starch, starch derivatives, gum arabic and mixtures thereof.

9. The developer sheet of claim 3 wherein said phenolic resin is a metallated phenolic resin.

10. The developer sheet of claim 2 wherein said binder is present in an amount of about 2% to 20%.

11. A self-contained recording sheet for forming an image comprising:

a substrate having front and back surfaces; and a recording layer on said front surface, said recording layer including microcapsules which contain a color precursor of the electron donating type in a carrier liquid, said recording layer further including a developer material which can react with said color precursor to form a visible image when said color precursor is released from the microcapsules, gas-filled and hollow compressible microspheres interspersed in said recording layer.

12. The self-contained recording sheet of claim 11 wherein said recording layer additionally includes a binder.

13. The self-contained sheet of claim 11 wherein said developer material is a phenolic resin.

14. The self-contained sheet of claim 11 wherein said developer material is an acid clay.

15. The self-contained sheet of claim 11 wherein said microspheres have a diameter of about 0.3 to 15 micron and are formed from an elastic synthetic organic polymer.

16. A coating composition for use in manufacturing a recording material comprising:

a binder;

a developer material which is capable of reacting with a color precursor to form color; and hollow gas-filled compressible microspheres.

17. A pressure sensitive recording material comprising a recording sheet including a support having a recording layer on one surface thereof, said recording layer including a developer material having gas-filled hollow compressible microspheres interspersed therein to provide improved image intensity.

18. The recording material of claim 17 wherein said developer layer further includes a binder.

19. The recording material of claim 17 wherein said developer material is a phenolic resin.

20. The recording material of claim 17 wherein said developer material is an acid clay.

21. The recording material of claim 17 wherein said microsphere have a diameter of about 0.3 to 15 micron and are formed from an elastic synthetic organic polymer.

22. The recording material of claim 17 wherein said recording layer contains about 5 to 50 percent by weight microspheres and about 4 to 40 percent by weight developer material.

23. The recording material of claim 18 wherein said binder is a synthetic binder, a natural binder or a mixture thereof.

24. The recording material of claim 23 wherein said binder is selected from the group consisting of polyvinyl acetate, styrene butadiene copolymer, starch, gum arabic or mixtures thereof.

25. The recording material of claim 19 wherein said phenolic resin is a metallated phenolic resin.

26. The recording material of claim 17 wherein said binder is present in an amount of about 2% to 20%.

* * * * *

UNITED STATES PATENT AND TRADEMARK OFFICE

CERTIFICATE OF CORRECTION

PATENT NO. : 5,932,515

DATED : August 3, 1999

INVENTOR(S) : John Kevin Rourke

It is certified that error appears in the above-identified patent and that said Letters Patent is hereby corrected as shown below:

Col. 13, line 45 (claim 11), after "microcapsule," add --and--.

Signed and Sealed this

Thirtieth Day of November, 1999

*Attest:*

*Attesting Officer*

Q. TODD DICKINSON

*Acting Commissioner of Patents and Trademarks*